US006358062B1

(12) United States Patent
Feldman et al.

(10) Patent No.: US 6,358,062 B1
(45) Date of Patent: Mar. 19, 2002

(54) COAXIAL CONNECTOR ASSEMBLY

(75) Inventors: Steven Feldman; Joseph N. Castiglione, both of Cedar Park, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/695,343

(22) Filed: Oct. 24, 2000

(51) Int. Cl.[7] ..... H01R 12/00
(52) U.S. Cl. ..... 439/63; 439/579; 439/581
(58) Field of Search ..... 439/63, 581, 578, 439/579

(56) References Cited

U.S. PATENT DOCUMENTS 4,650,271 A 3/1987 Forney, Jr. et al. ..... 339/177 R
4,891,017 A * 1/1990 Kuhn et al. ..... 439/380
5,679,006 A * 10/1997 Madelaine ..... 439/63
5,735,715 A * 4/1998 Olson ..... 439/682
5,851,121 A * 12/1998 Thenaisie et al. ..... 439/63
6,045,402 A * 4/2000 Embo et al. ..... 439/579
6,132,244 A * 10/2000 Leeman et al. ..... 439/579

* cited by examiner

*Primary Examiner*—Tho D. Ta
(74) *Attorney, Agent, or Firm*—Yen Tong Florczak

(57) ABSTRACT

A coaxial connector assembly for attachment to a printed circuit board includes a plurality of dielectric insulators integrally formed with each other. A plurality of longitudinal signal contacts and shield tubes are positioned within and around, respectively, each of the insulators. A terminal end of each of the signal contacts and shield tubes is adapted for connecting to a printed circuit board. The connector may optionally include a housing integrally formed with the insulators.

20 Claims, 16 Drawing Sheets

COAXIAL CONNECTOR ASSEMBLY

BACKGROUND OF THE INVENTION

The present invention relates to electrical connectors and more particularly to interconnections made between a multilayer printed circuit board and a high speed coaxial cable.

The interconnection of integrated circuits to other circuit boards, cables, or other electronic devices is well known in the art. As the speed of the electronic devices increase, there is a growing need to design and fabricate printed circuit boards and their accompanying interconnects with closely controlled electrical characteristics to achieve satisfactory control over the integrity of the transmitted signal. The extent to which the electrical characteristics (such as impedance) must be controlled depends heavily upon the bandwidth of the circuit. That is, the faster the signal rise-time, the greater the importance of providing an accurately controlled impedance within the interconnect.

Because of their favorable electrical characteristics, coaxial cables and connectors have grown in popularity for high performance systems. As is known in the art, coaxial connectors provide an inner or signal conductor coaxially disposed within an outer conductor, with a dielectric material disposed therebetween. It is well known to mount coaxial connectors on a printed circuit board, with the signal conductor electrically connected to a signal circuit of the printed circuit board and the outer conductor electrically connected to a ground circuit of the printed circuit board. The electrical connections between the coaxial connector and the printed circuit board are typically made by soldering. Examples of such connectors can be seen, for example, in U.S. Pat. No. 4,650,271.

However, coaxial cable connectors are relatively bulky in comparison to other pin and socket type connectors. The size of currently available coaxial connectors makes it extremely difficult, if not impossible, to mount a large number of connectors on the limited space of a typical printed circuit board. A need thus exists for a coaxial cable connector assembly that allows multiple coaxial cables to be connected to a printed circuit board using less space than traditional coaxial cable connectors, while maintaining the sought after performance of the coaxial system. In addition, it is desired that such a connector could be used with current assembly technology, such as pick and place equipment.

SUMMARY OF THE INVENTION

The invention described herein is a connector assembly which may be attached to a printed circuit board and which provides multiple coaxial connectors in a package which is more compact and easier to assembly than currently available coaxial connectors. The connector assembly uses a plurality of dielectric insulators which are integrally formed with each other. The individual insulators are spaced from each other by a web member. A signal pin or conductor is positioned coaxially within each insulator, and a ground or shield tube is positioned concentrically around the signal pin and shield tube. Because the plurality of insulators are positioned at a predetermined spacing, the signal pins and shield tubes may be gang-loaded on the insulators. An external housing member may be provided for the plurality of insulators. Preferably, such external housing is integrally formed with the plurality of insulators.

DETAILED DESCRIPTION OF THE INVENTION

Figure 1A:
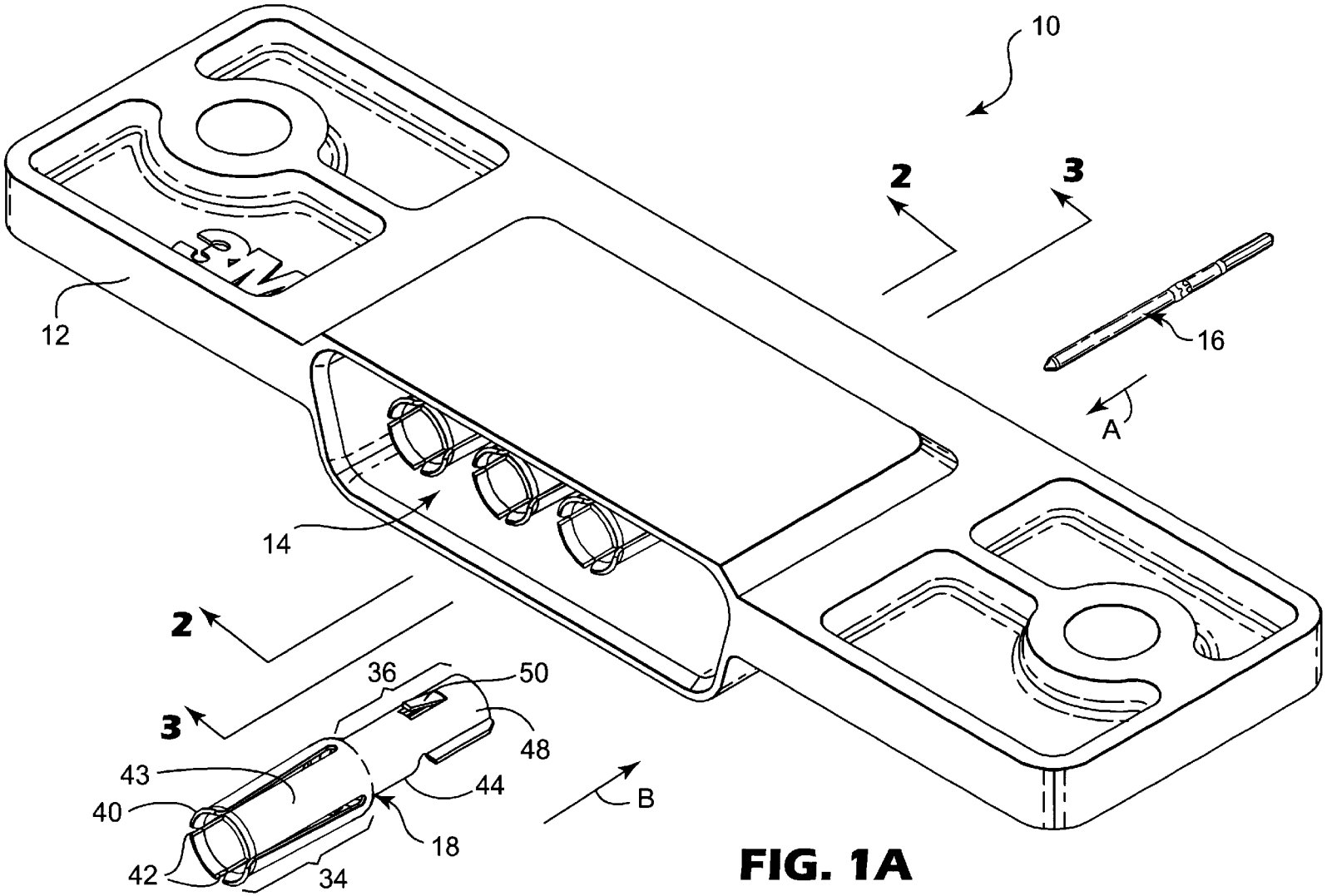
FIG. 1A is a perspective view, with some elements exploded, of the inventive connector assembly.
Figure 1B:
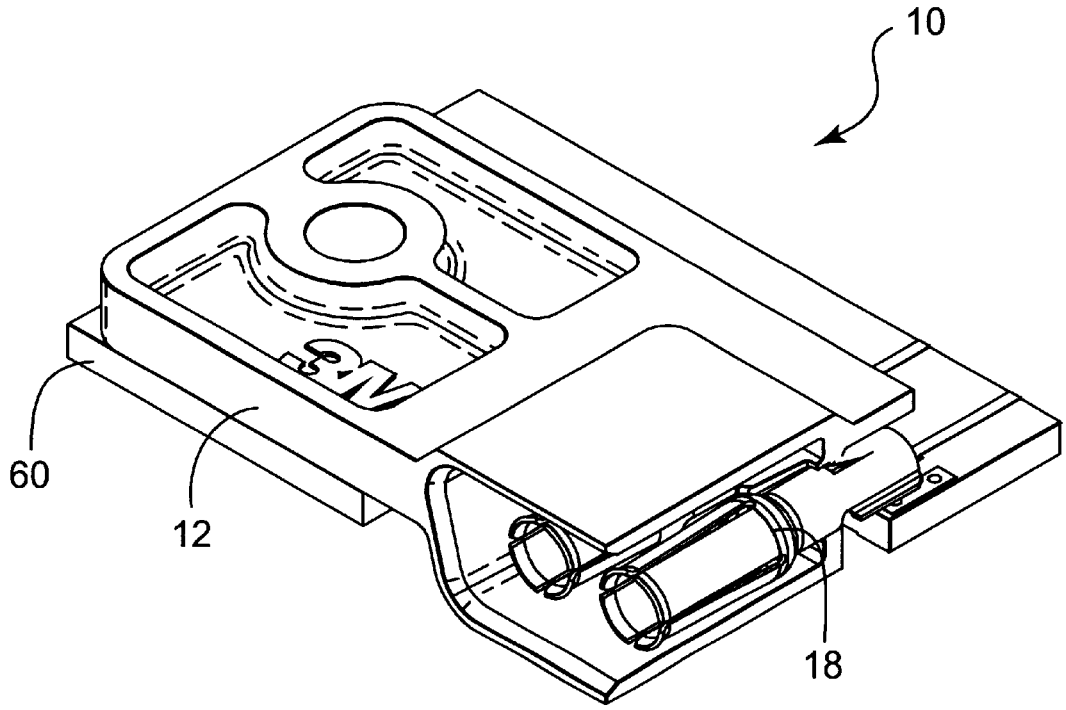
FIG. 1B is a perspective sectional view of the inventive connector assembly, taken along line 1B—1B of FIG. 1.

Referring first to FIGS. 1A and 1B, a coaxial connector assembly 10 is shown having a housing 12 which includes a cavity 14 containing the coaxial connector components. The coaxial connector components include a plurality of longitudinal signal contacts 16, and a plurality of conductive shield tubes 18. Within the cavity 14, each one of the signal contacts 16 is coaxially aligned within a corresponding one of the shield tubes 18. The coaxially aligned signal contacts 16 and shield tubes 18 are separated from each other by a dielectric insulator 20 positioned therebetween. The dielectric material of insulator 20 is selected for, among other properties, its dielectric constant which provides the desired characteristic impedance in connection with the geometry of the other impedance controlling elements. It is desired that the dielectric constant of the insulator 20 substantially matches the dielectric constant of the printed circuit board 60 to prevent pulse spreading. Although FIG. 1A illustrates a coaxial connector assembly 10 having four coaxial connectors, it is the intent of this invention, and it will be understood by those skilled in the art, that the connector assembly could include any desired number of coaxial connectors positioned at any desired spacing.

Figure 2A:
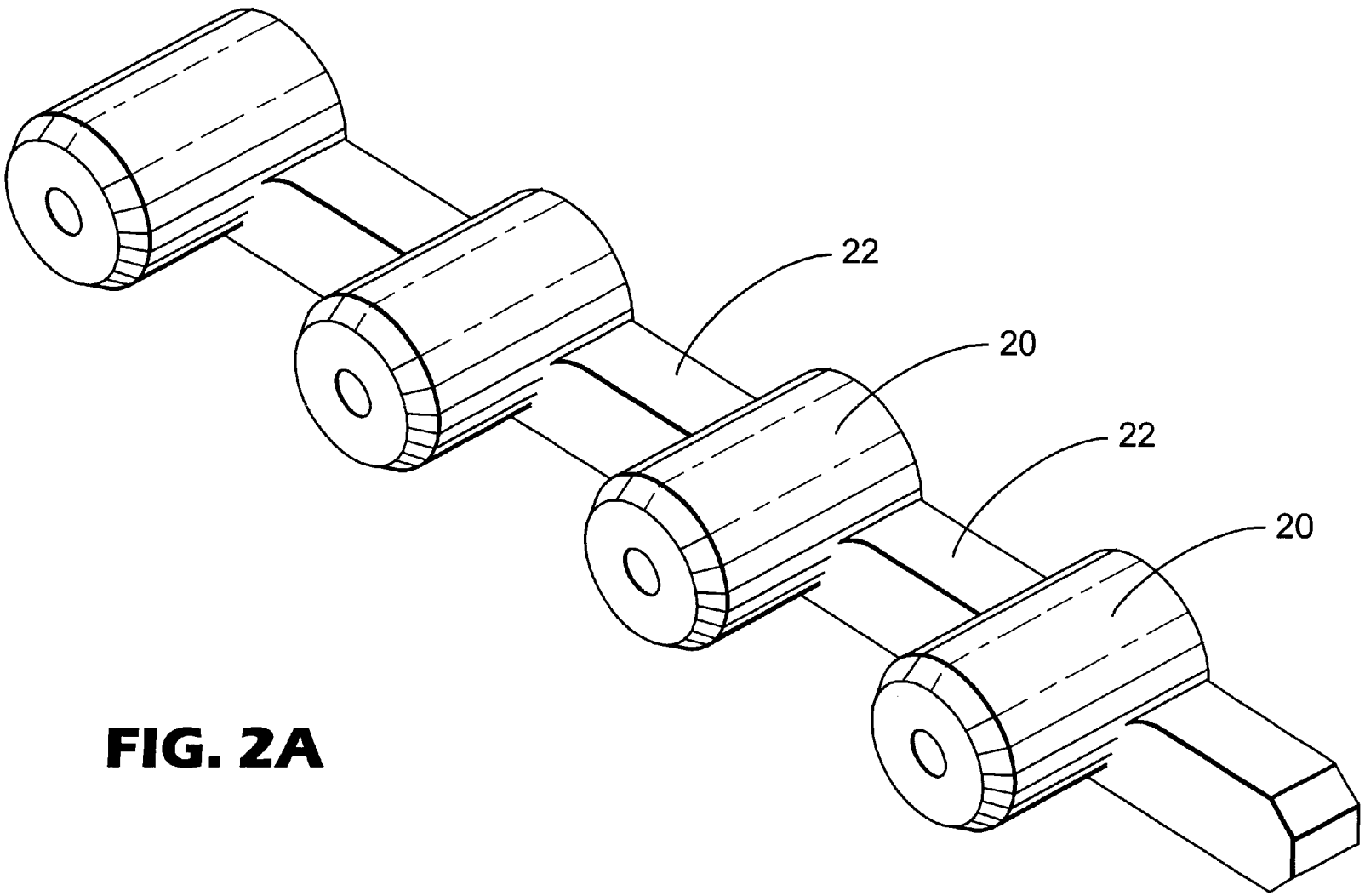
FIG. 2A is a perspective view of a plurality of integrally molded insulators.
Figure 2B:
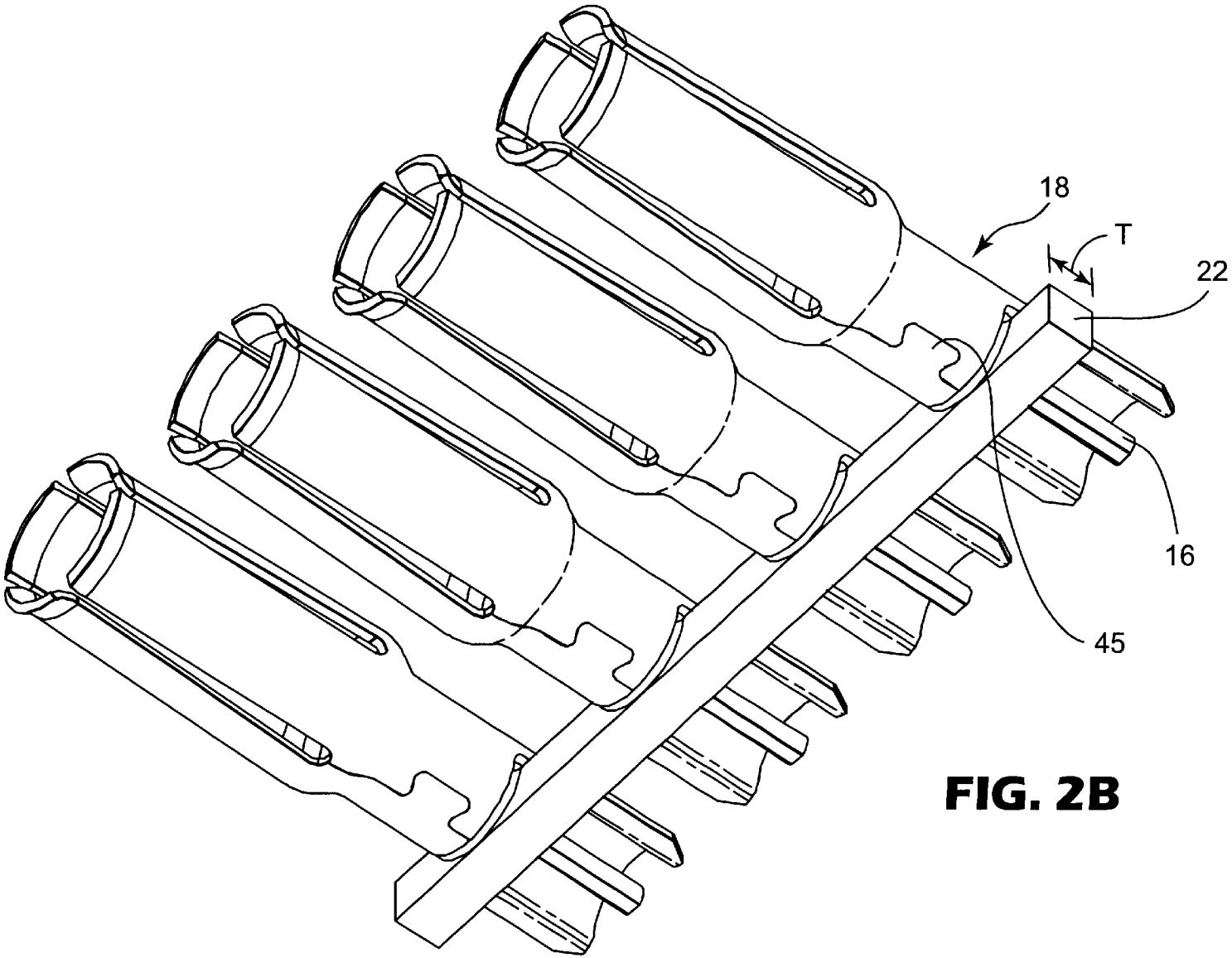
FIG. 2B is a perspective front view of a plurality of integrally molded insulators with signal contacts and shield tubes.
Figure 2C:
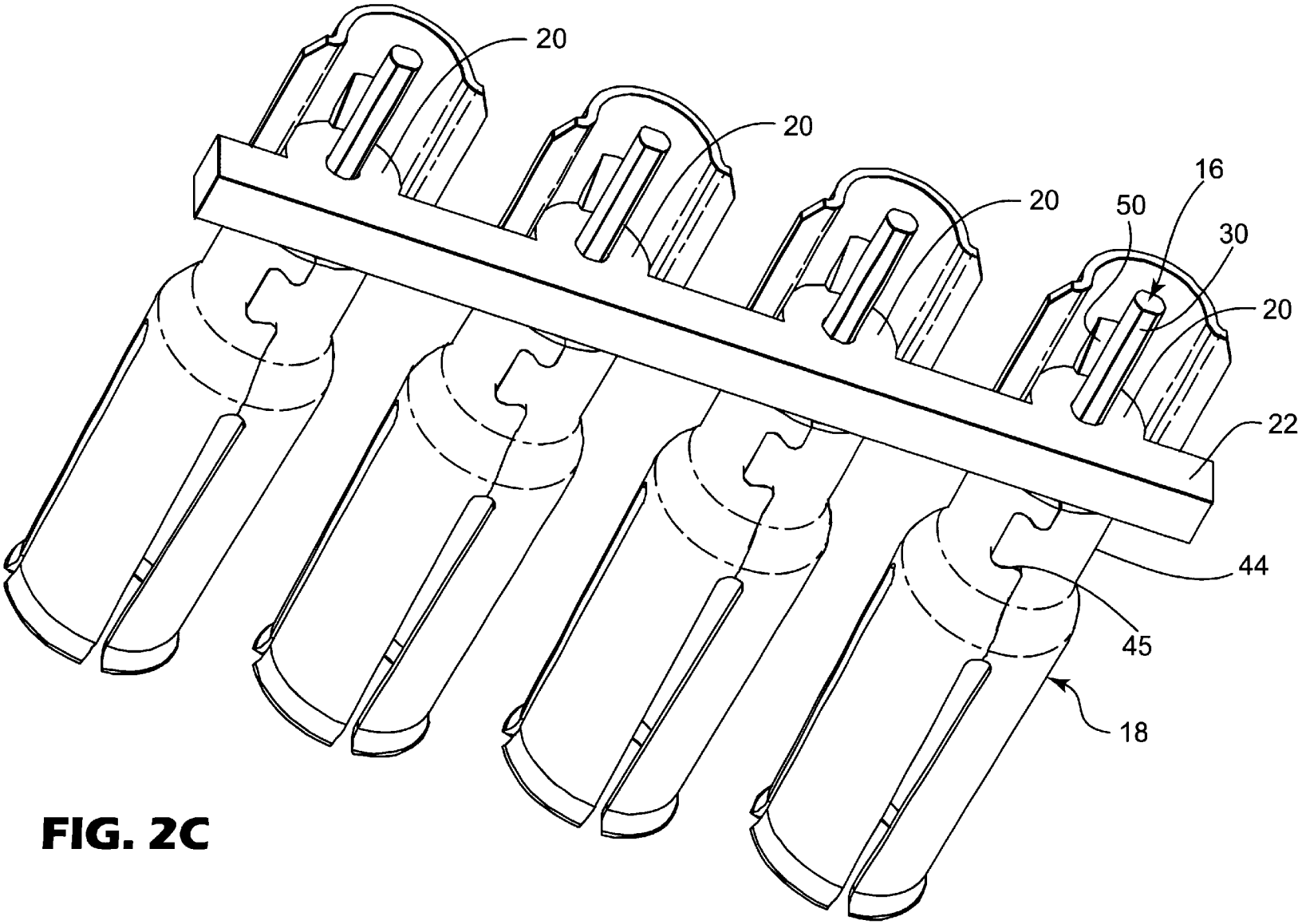
FIG. 2C is a perspective rear view of the connector assembly of FIG. 2B.
Figure 3A:
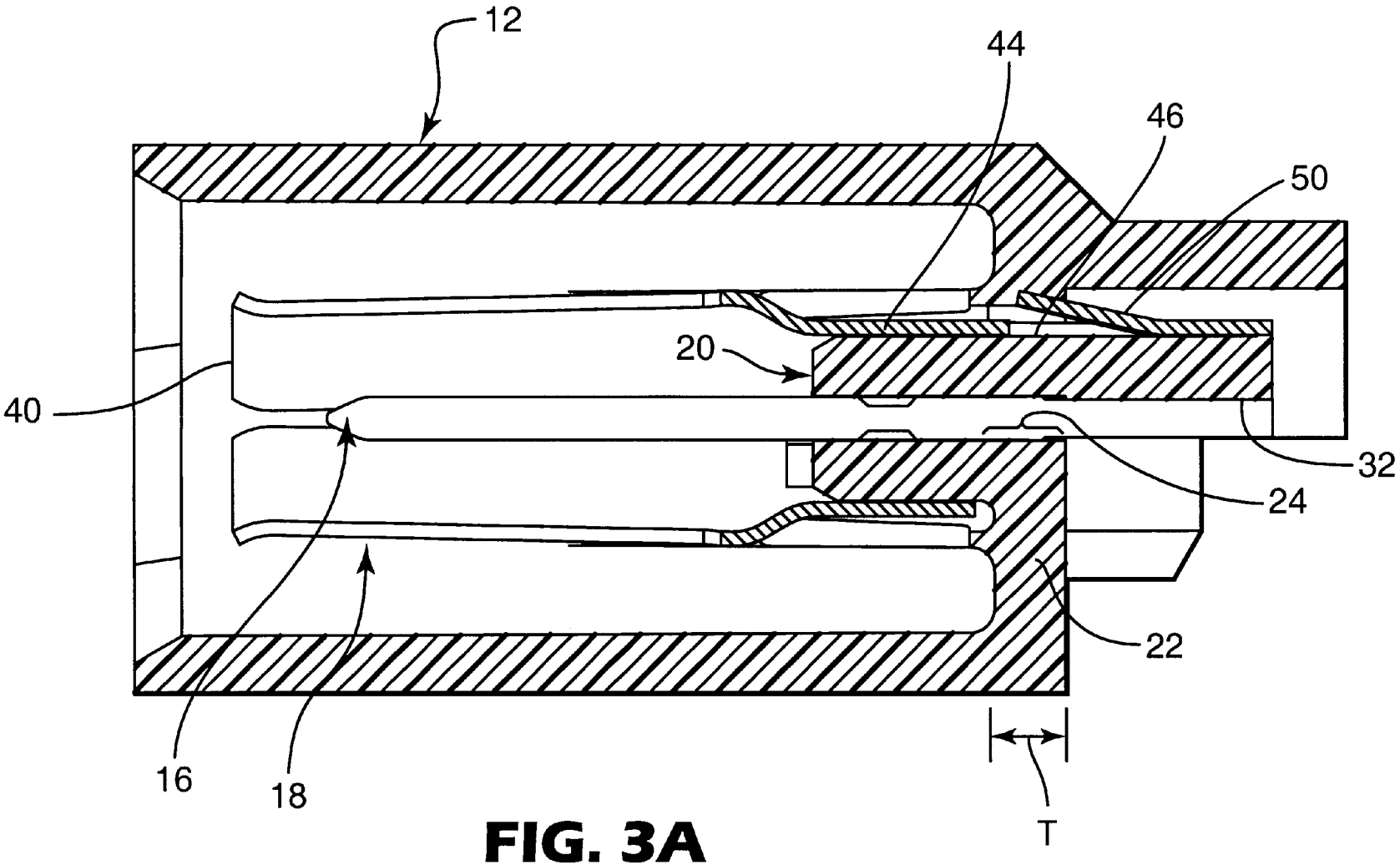
FIG. 3A is a cross-sectional view of the inventive connector assembly, taken along line 3—3 of FIG. 1.
Figure 3B:
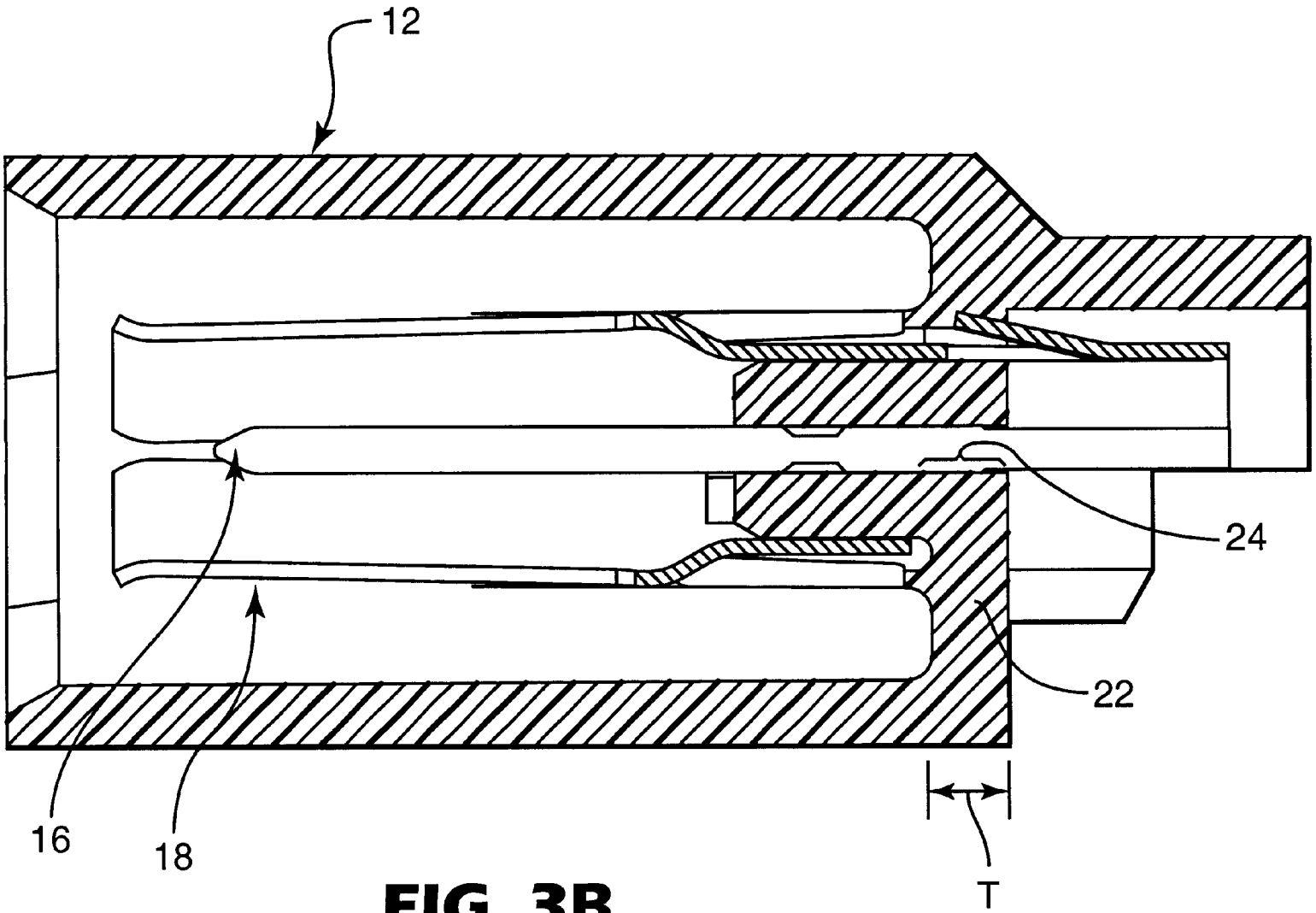
FIG. 3B is a cross-sectional view of an alternate embodiment of the inventive connector assembly, taken along a similar perspective as FIG. 3A.

As clearly seen in FIGS. 2A–2C, the dielectric insulators 20 have a tubular shape such that the signal contacts 16 and shield tubes 18 may be inserted into and about the insulators 20, respectively. The insulators 20 are integrally formed with each other, such as by molding, and are connected to each other by a web 22. If desired, and as shown in FIGS. 3A and 3B, the plurality of insulators 20 may also be integrally formed with housing 12, where housing 12 extends from web 22 to surround insulators 20.

By forming insulators 20 integrally with each other and, if desired, with housing 12, the assembly of connector 10 is greatly simplified. Specifically, insulators 20 are already properly positioned at the desired pitch, thereby allowing signal contacts 16 and shield tubes 18 to be gang-loaded into insulators 20, either by hand or using automated equipment. The design of connector assembly 10 eliminates the need to separately assemble each of the signal contacts 16 into the insulators 20, then stake, crimp or otherwise lock insulators 20 in the ground tubes 18, and then position that subassembly into connector housing 12.

The design of connector assembly 10 also allows multiple coaxial connectors to be closely positioned to each other on a printed circuit board. If, as illustrated in FIGS. 2B and 2C, no housing is required, the plurality of insulators 20 are secured to the printed circuit board by shield tubes 18. That is, when the connector assembly 10 is soldered to a printed circuit board, web 22 is trapped between the shield tubes 18 and the edge of the printed circuit board, thereby preventing insulators 20 from being dislodged. If a housing is required for connector assembly 10, (as illustrated, for example, in FIGS. 1, 2, 3A and 3B) only a single housing 12 for all of the coaxial connectors is needed, thereby reducing the use of scarce space on the printed circuit board. When only a single housing is used, there is not a need for separate mounting means for each coaxial connector. Rather, mounting means may be included in the single housing 12 for securing all of the contained coaxial connectors to the printed circuit board. The design also allows a plurality of coaxial connectors to be simultaneously positioned and connected to a printed circuit board, thereby reducing assembly steps and time.

The thickness T of web 22 is preferably less than ¼ of the wavelength of the highest frequency signal for which the connector assembly 10 is designed. In this manner, the unshielded portion 24 of the signal contact 16 is less than ¼ wavelength, which greatly reduces electromagnetic radiation escaping the unshielded portion of the connector and interfering with other nearby electrical signals.

Figure 4A:
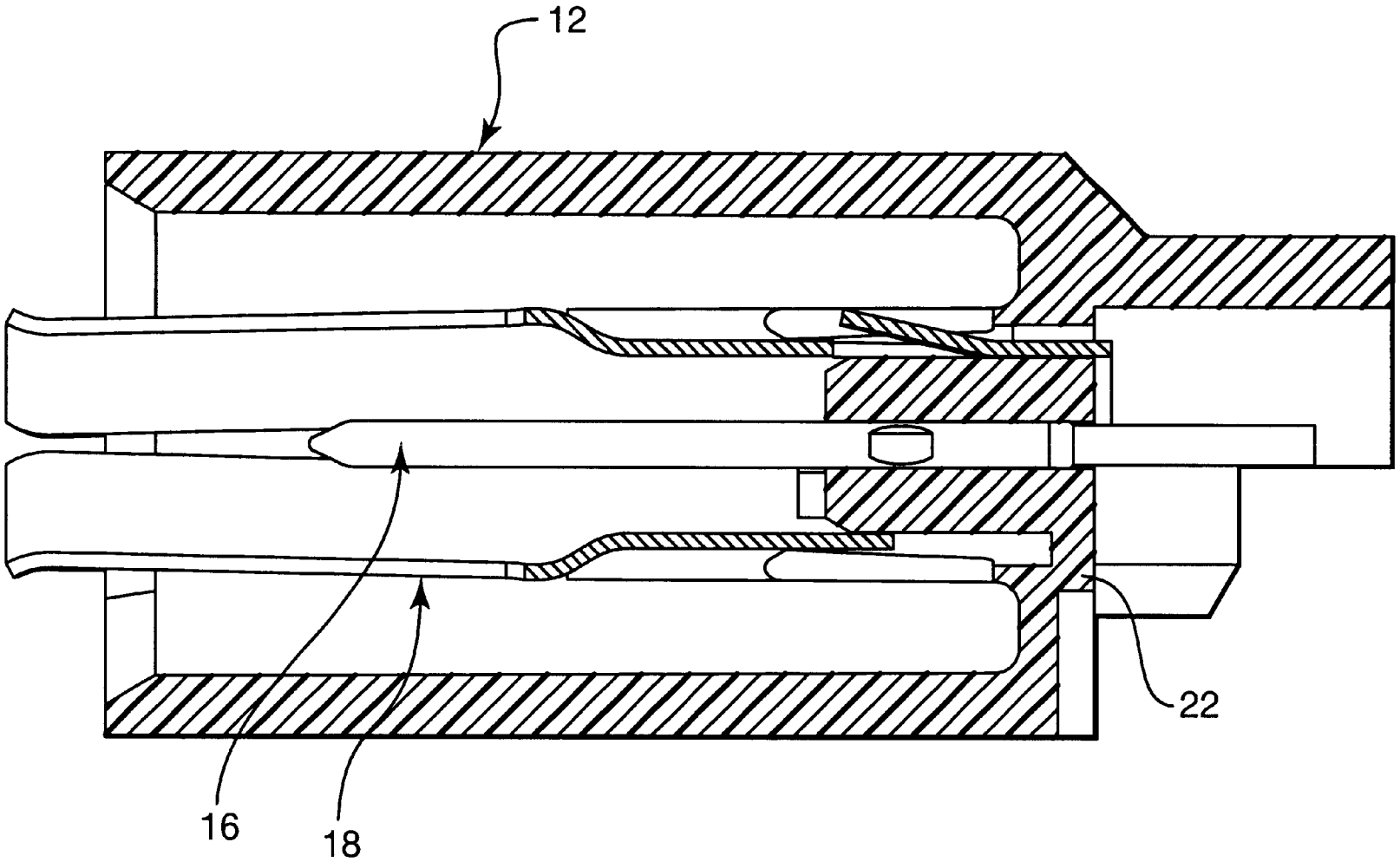
FIGS. 4A–4C are cross-sectional views of an alternate embodiment of the inventive connector assembly, illustrating separation of the insulator from the housing during connector assembly.
Figure 4B:
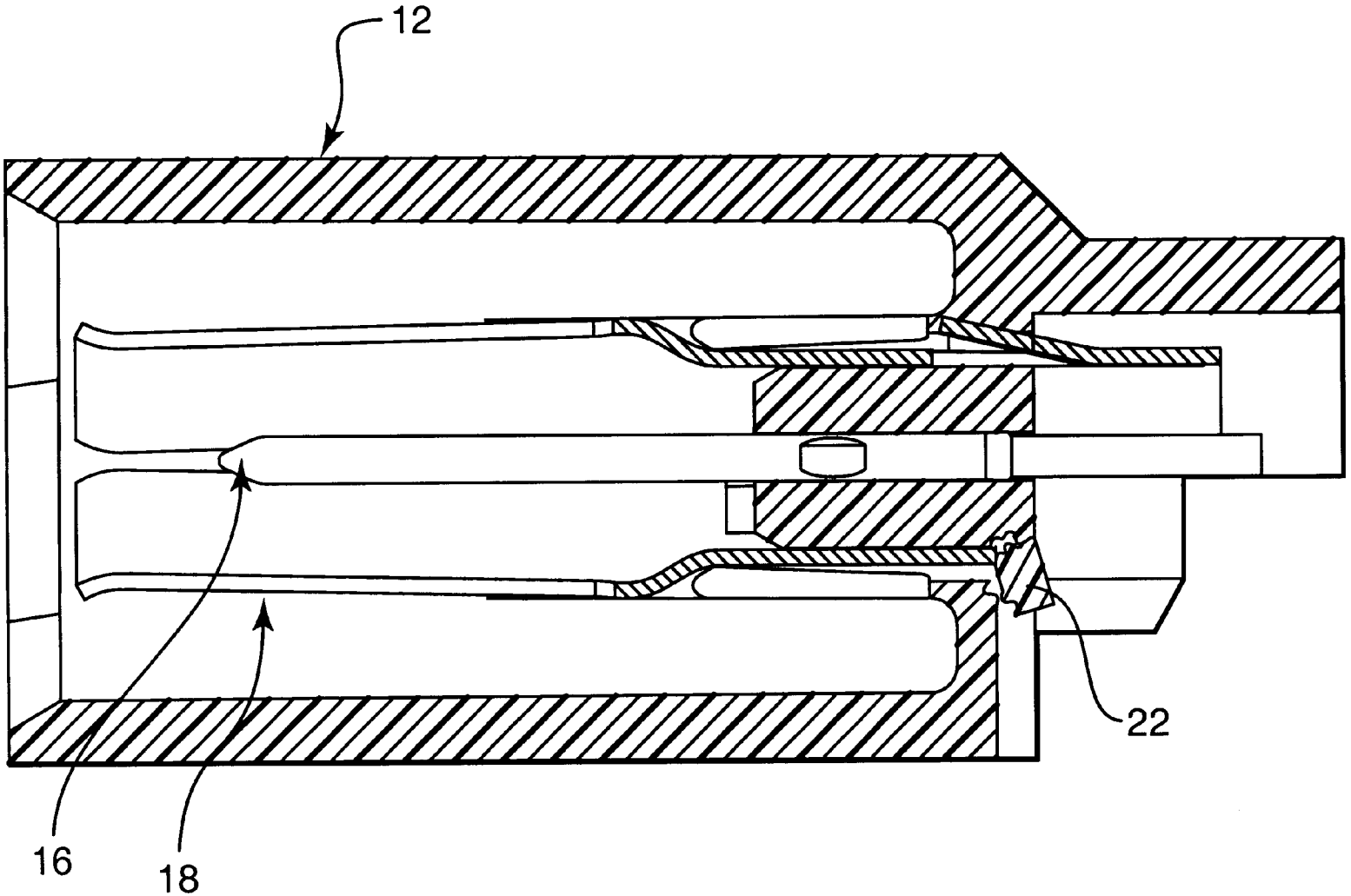
Figure 4C:
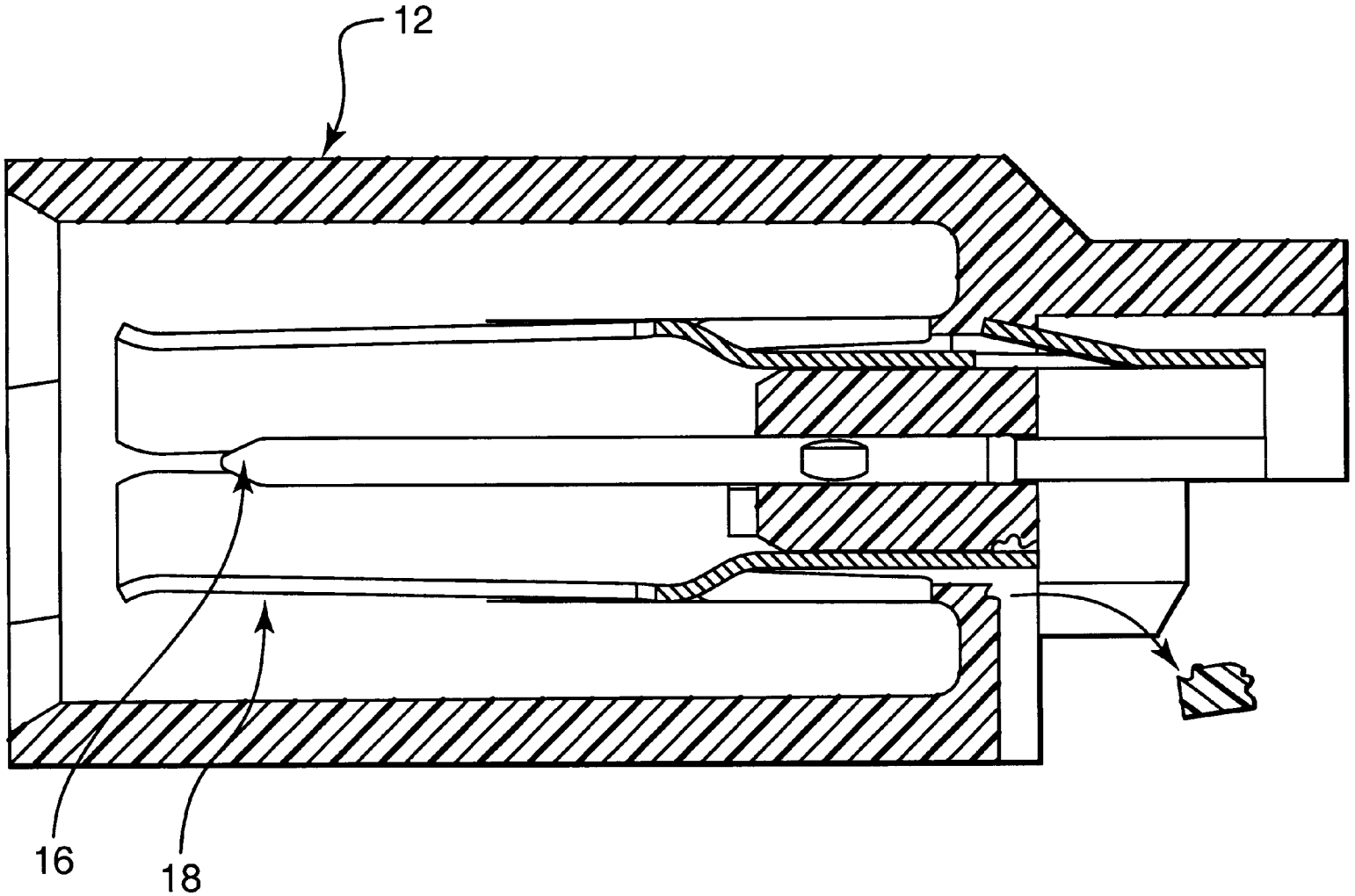

As illustrated in FIGS. 4A–4C, web 22 may be designed to fracture upon placement of shield tube 18 onto insulator 20. This arrangement may be preferred if a greater degree of EMI shielding is desired or required for the connector. The connector as shown in FIGS. 4A–4C permits the full circumference of ground tube 18 to extend to the edge of the printed circuit board, further reducing or eliminating the unshielded portion of the signal contact 16.

Figure 5A:
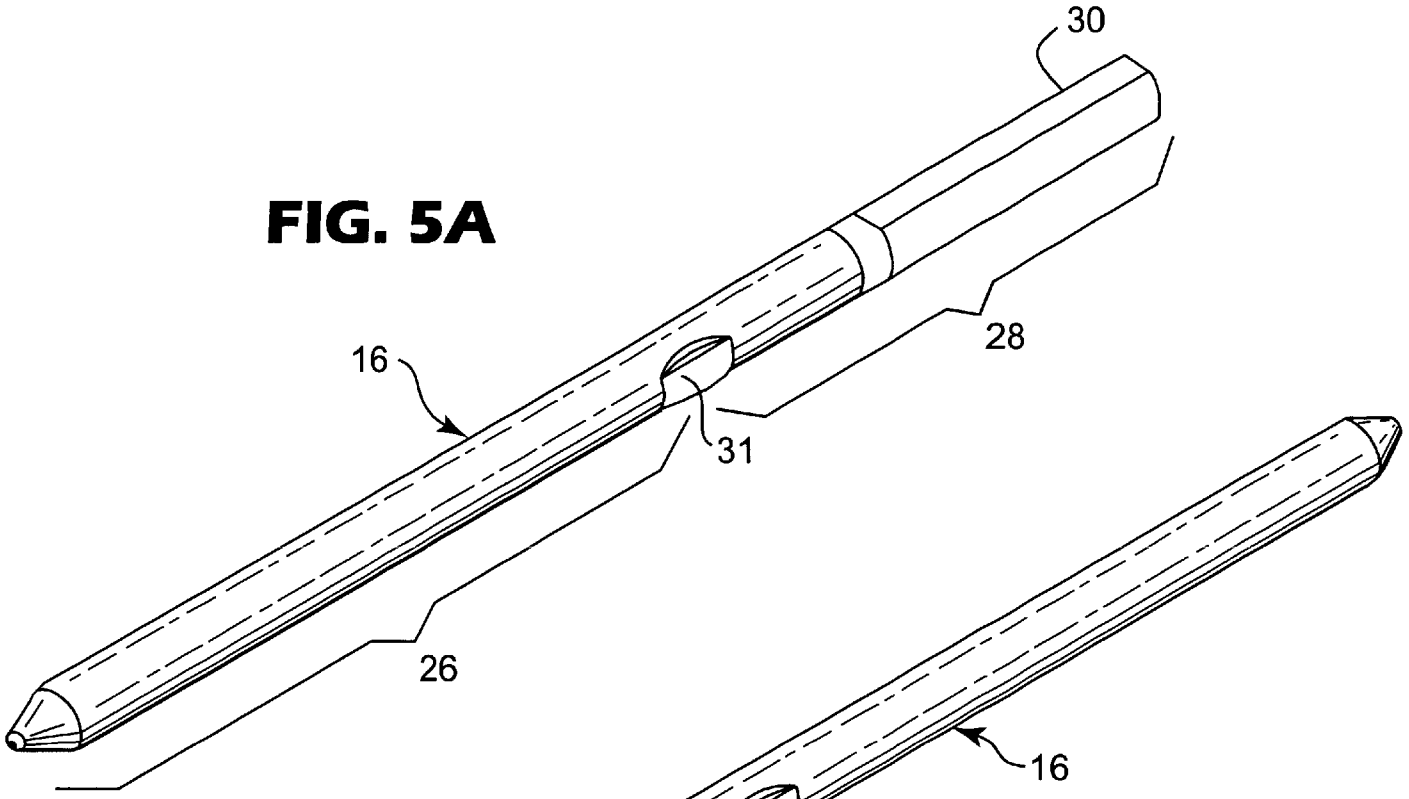
FIGS. 5A and 5B are an enlarged perspective view of the signal contact of the connector assembly.
Figure 5B:
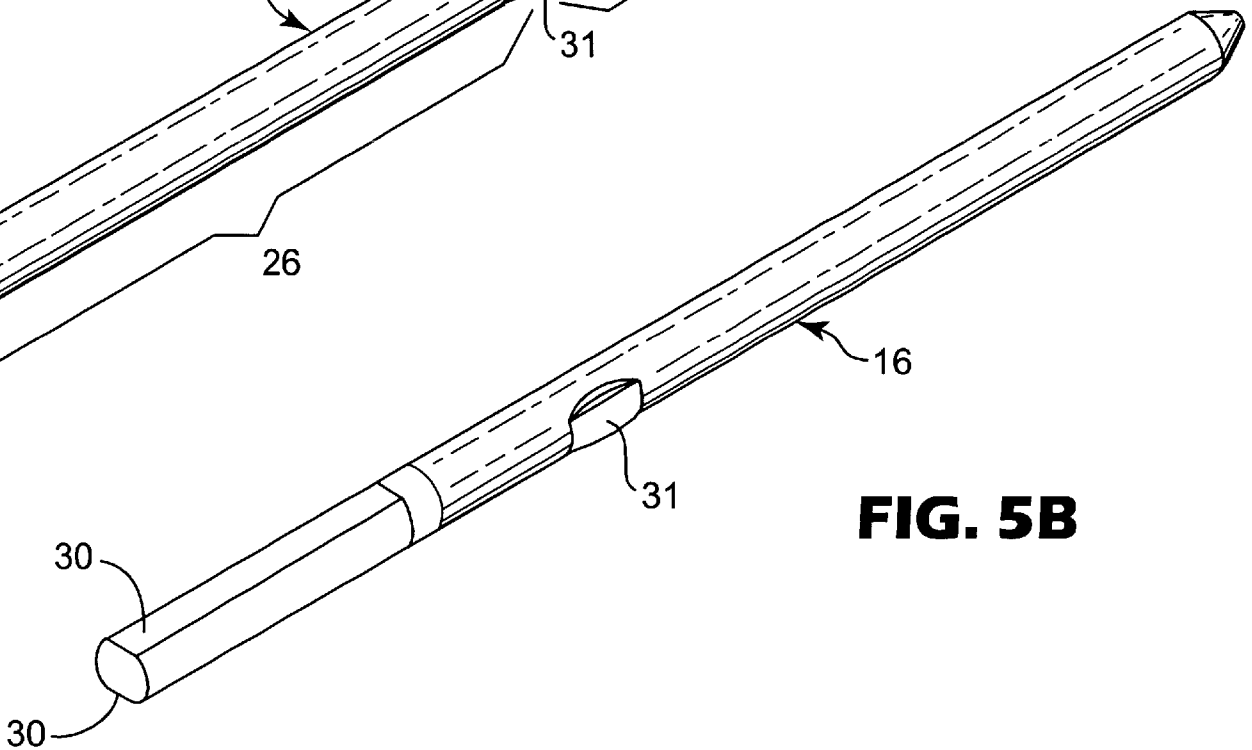

Describing the individual elements in greater detail, it can be seen in FIG. 5A and 5B that signal contact 16 includes a mating end 26 and a termination end 28. The mating end 26 is preferably round in cross-section, while the termination end 28 preferably includes at least one flat surface 30 for connection to a printed circuit board 60. Additional flat surfaces can be added to the termination end 28 to improve the ability of assembly tooling to correctly hold and orient the signal contact 16.

The flat surface 30 is preferably created by deforming termination end 28 in a "coining" or pressing process. In this manner, material of signal contact 16 is displaced such that the flattened portion of termination end 28 is wider than the diameter of the mating end 26 is signal contact 16. This confers several benefits to the connector. The flat surface 30 reduces variability in solder meniscus size when attached to the printed circuit board. This in turn improves the characteristic impedance tolerance of the soldered connector. In addition, the flat surface 30 increases the solder fillet area, which in turn increases solder joint strength. It is preferred that the cross-sections of mating end 26 and termination end 28 share the same longitudinal axis.

The signal contacts 16 may be press-fit into the inner bore 32 of each of the insulators 20. Because of the widened dimension of flat surface 30 on termination end 28, it is necessary to load signal contacts 16 into insulators from the back end of insulators 20 in the direction of Arrow A in FIG. 1A. Preferably, a retention feature 31 is created to retain signal contact 16 within insulator 20. Because of the known spacing and orientation of the insulators 20, all of the signal contacts 16 for an entire coaxial connector assembly 12 may be simultaneously press fit in a single operation. When signal contacts 16 are installed in insulators 20, it is preferred that flat surfaces 30 are coplanar with the board mounting surfaces of housing 12, and that flat surfaces 30 are coplanar with each other.

As seen in FIG. 1A, the shield tubes 18 which are positioned concentrically about the signal contacts 16 include a mating section 34 and a termination section 36. Shield tubes are preferably formed from sheet metal. The mating section 34 is of the type known in the art, and includes a forward end 40 which is preferably flared outwardly for smoothly mating with a complimentary coaxial connector (not shown). The forward end 40 of the mating section 34 preferably extends beyond the end of signal contact 16, such that ground contact is made prior to electrical connection of the signal contact. The mating section 34 includes slots 42 which extend axially toward termination section 36. Slots 42 increase the radial flexibility of mating section 34 when receiving a complementary coaxial connector therein. The spring finger portions 43 between slots 42 may additionally be tensioned so as to make secure contact with the complimentary connector. Termination section 36 includes a hood portion 48 which extends over the length of the termination end 28 on the printed circuit board.

The termination section 36 of shield tube 18 also includes a barrel portion 44 sized to fit around the exterior 46 of insulator 20. As clearly seen in FIGS. 2B and 2C, barrel portion 44 includes a closed locking seam 45 which prevents barrel portion 44 from opening upon installation over insulator 20, or in reaction to the forces applied during mating of the connector system. Locking seam 45 preferably provides ohmic contact to evenly distribute current around the circumference of shield tube 18.

Shield tube 18 is slidably mounted over insulator 20 in the direction of Arrow B in FIG. 1. Unlike conventional coaxial connector construction, there is no fixed attachment (such press, crimp, state, roll-forming or snap fit) between shield tube 18 and insulator 20. Rather, shield tube 18 is locked onto insulator 20 or housing 12 by a locking element 50 after shield tube 18 has been fully inserted onto insulator 20. This attachment method eliminates the need to apply hoop stress to barrel portion 44 of shield tube 18, which could force open the seam of that portion of shield tube 18. An additional benefit is that no additional assembly operations are required to secure shield tube 18 to insulator 20. It will be noted that the clearance between shield tube 18 and insulator 20 required for slip-fit assembly as described herein results in a circumferential air gap between shield tube 18 and insulator 20. This air gap is one of the impedance controlling elements for the connector assembly.

As shown in FIG. 2C, locking element 50 may be a spring biased tab or barb which engages the back side of insulator 20. Or, as shown in FIGS. 3A and 3B, locking element 50 may engage housing 12 to prevent shield tube 18 from being removed from insulator 20. In a connector like that shown in FIG. 3A, locking element 50 also functions to bias shield tube 18 against insulator extension 32, thereby eliminating or reducing any air gap which would affect the connector impedance. In a connector like that shown in FIG. 3B (without insulator extension 32), locking element 50 also functions to bias the solder feet 52 against the printed circuit board.

Figure 6A:
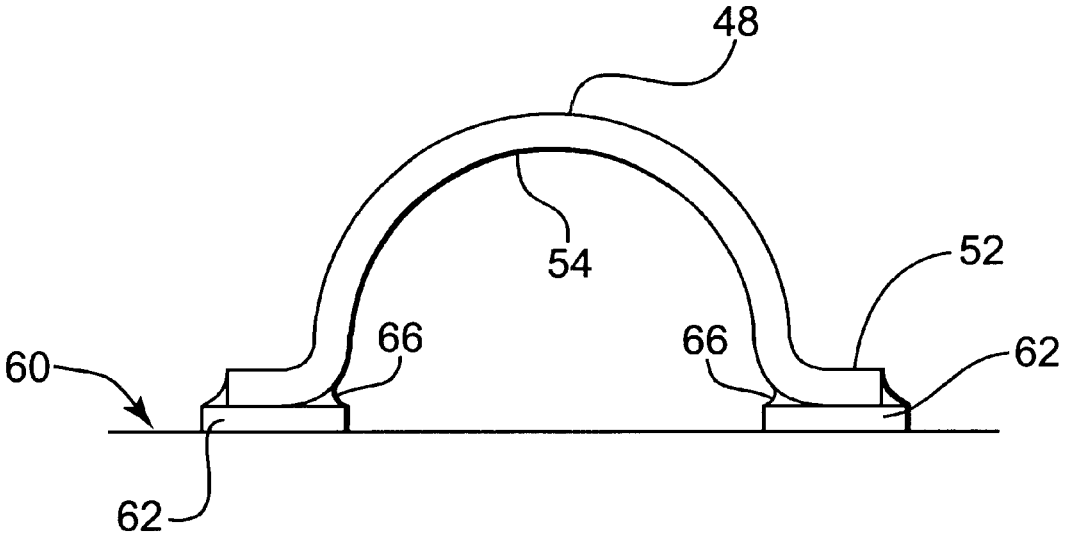
FIG. 6A is a cross-sectional view of a preferred embodiment of the termination end of the shield tube.
Figure 6B:
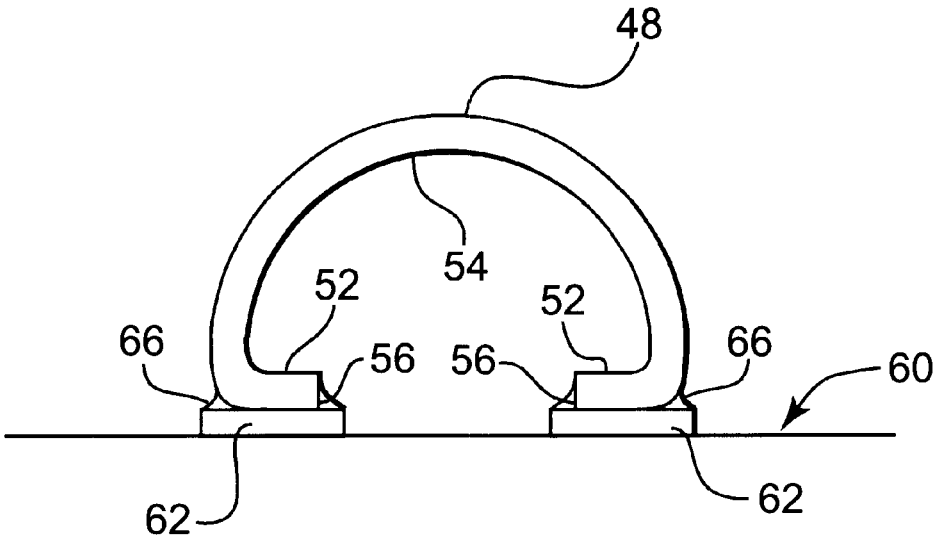
FIG. 6B is a cross-sectional view of an alternate embodiment of the termination end of the shield tube.

The hood portion 48 of shield tube 18 extends over the length of signal contact 16 above the plane of the printed circuit board 60 to which coaxial connector assembly 10 is secured. Although not required, the hood portion 48 preferably includes contact feet 52 for connection to printed circuit board 60, such as by soldering or other means known in the art. The contact feet 52 may extend outwardly from the hood portion 48 (see FIG. 6A) so that the inner periphery 54 of hood portion 48 is the innermost portion of the impedance controlling geometry of the termination end, or may alternately extend inwardly from the hood portion 48 (see FIG. 6B) so that the inner longitudinal edges 56 of the contact feet 52 are the innermost portion of the impedance controlling geometry of the termination end.

As seen in FIGS. 2B and 2C, shield tube 18 cooperates with web 22 to ensure proper alignment and orientation of hood portion 48 and feet 52. Specifically, as hood portion 48 rests against web 22, shield tube 18 is prevented from rotating, thereby ensuring feet 52 are in parallel alignment with the surface of the printed circuit board 60. In addition, shield tube 18 is prevented from over-extending onto the printed circuit board 60.

As noted above, shield tube 18 is preferably formed from sheet metal. This confers several advantages to the connector assembly, including: reduced cost as compared to machining, molding, extruding or casting manufacturing methodologies; ease of forming locking element 50; ability to use pre-plated stock to further reduce cost and provide greater plating uniformity; and reduced roughness of the surface finish. This last advantage reduces plating wear on mating surfaces, lowers insertion and withdrawal forces, and improves high frequency performance of the connector.

Figure 7A:
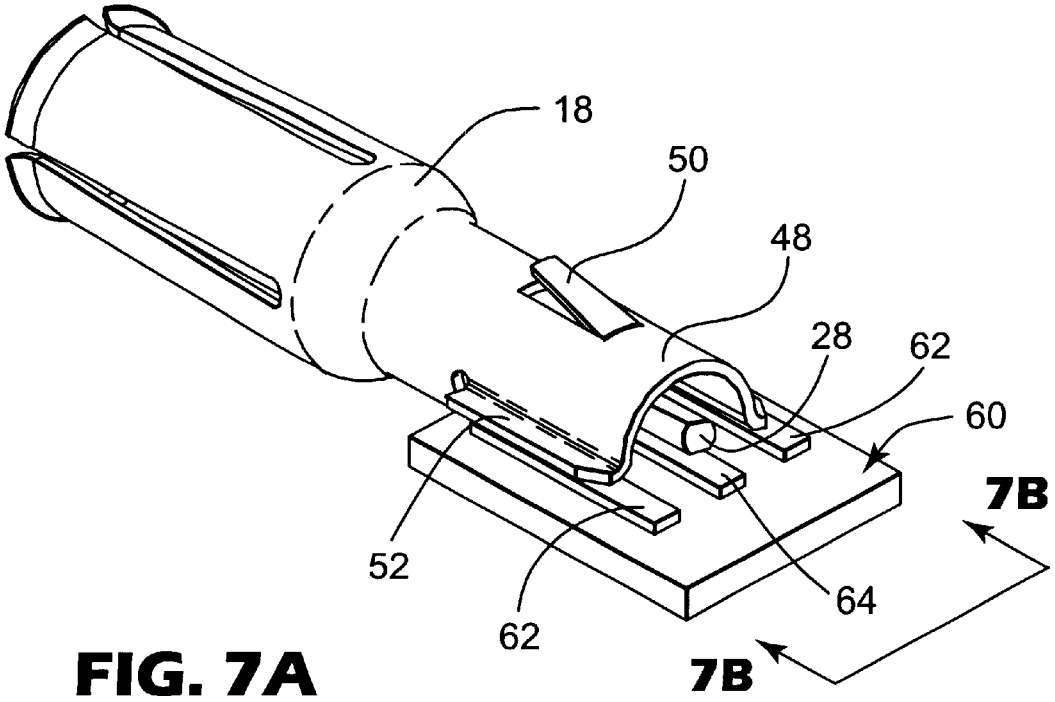
FIG. 7A is a perspective view illustrating the connection of the signal contact and shield tube to a printed circuit board.
Figure 7B:
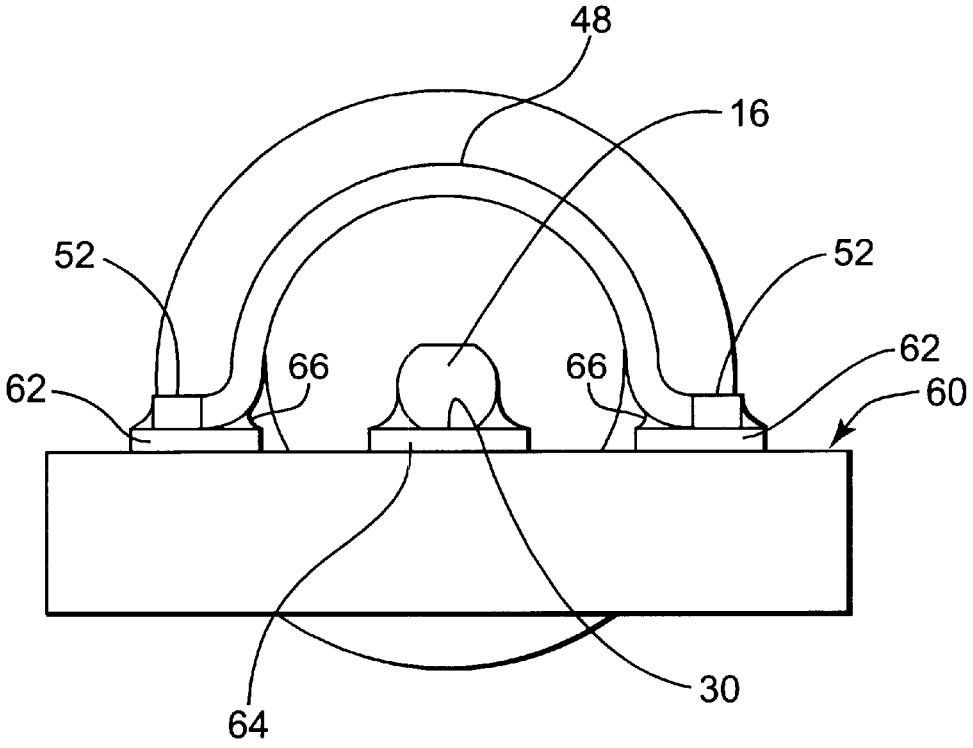
FIG. 7B is an end view of the connection of the signal contact and shield tube to a printed circuit board, taken in the direction of line 7B—7B of FIG. 7A.

The printed circuit board 60 to which the connector assembly 12 is secured includes solder pads 62, 64 for solder attachment of the termination end 28 of signal contact 16 and contact feet 52 of shield tube 18 coaxial connector. As seen in FIG. 7B, the ground circuit solder pads 62 are preferably outward of the innermost portion of the shield tube hood portion 48 to minimize the formation of solder meniscus 66 in the controlled impedance area of the connector. In addition, the width of the signal contact solder pad 64 is preferably close in size to the width of the signal contact flat portion 30 to minimize the formation of a solder meniscus 68. In this manner, the characteristic impedance of the connector will be minimally affected by the soldering operation.

Figure 8:
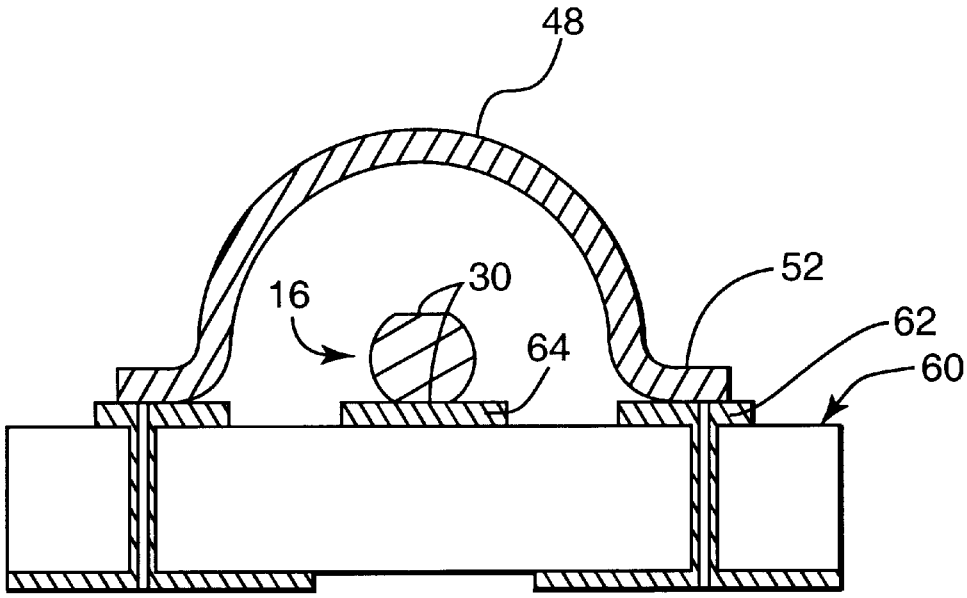
FIG. 8 is a cross-sectional view illustrating the connection of the signal contact and shield tube to a printed circuit board, where the ground plane is discontinuous and the dielectric between the signal contact and shield tube hood portion is air.
Figure 9:
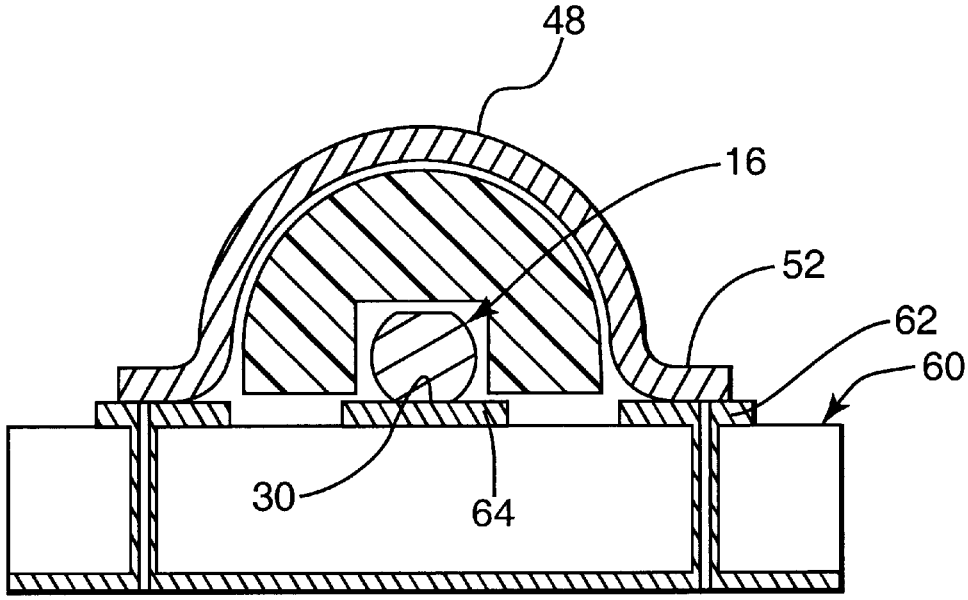
FIG. 9 is a cross-sectional view illustrating the connection of the signal contact and shield tube to a printed circuit board, where the ground plane is continuous and the dielectric between the signal contact and shield tube hood portion is not air. The connection to the printed circuit board approximates a coaxial geometry.

The hood portion 48 of shield tube 18 which partially surrounds signal contact 16 is spaced from signal contact 16 in such a manner as to provide a desired characteristic impedance for the connector. This spacing is dependent on the dielectric between the signal contact 16 and the hood portion 48 of the shield tube 18. The dielectric may be either air (see FIG. 8) or a material other than air (see FIG. 9), specifically the same material which forms the housing 12 and the insulator 20.

The connector assembly may be configured such that when the connector assembly is attached to a printed circuit board, the combined conductive and dielectric elements of the coaxial connector and the printed circuit board approximate a coaxial geometry for transverse electromagnetic mode (TEM) signal propagation. An example of such a configuration may be seen in FIG. 10. In such a configuration, it is preferred that the dielectric constant of insulator 20 is approximately the same as the dielectric constant of the printed circuit board substrate material.

In designing and constructing the coaxial connector assembly described herein, numerous factors influence the characteristic impedance of the connector. The characteristic impedance of the length of the connector termination end is preferably designed to be slightly higher than the desired "target" impedance. In this manner, final "trimming" to the desired impedance can be made by adjusting any or several circuit board impedance controlling elements, such as solder pad dimensions and spacing, ground plane area, dielectric thickness and substrate dielectric constant.

Figure 10:
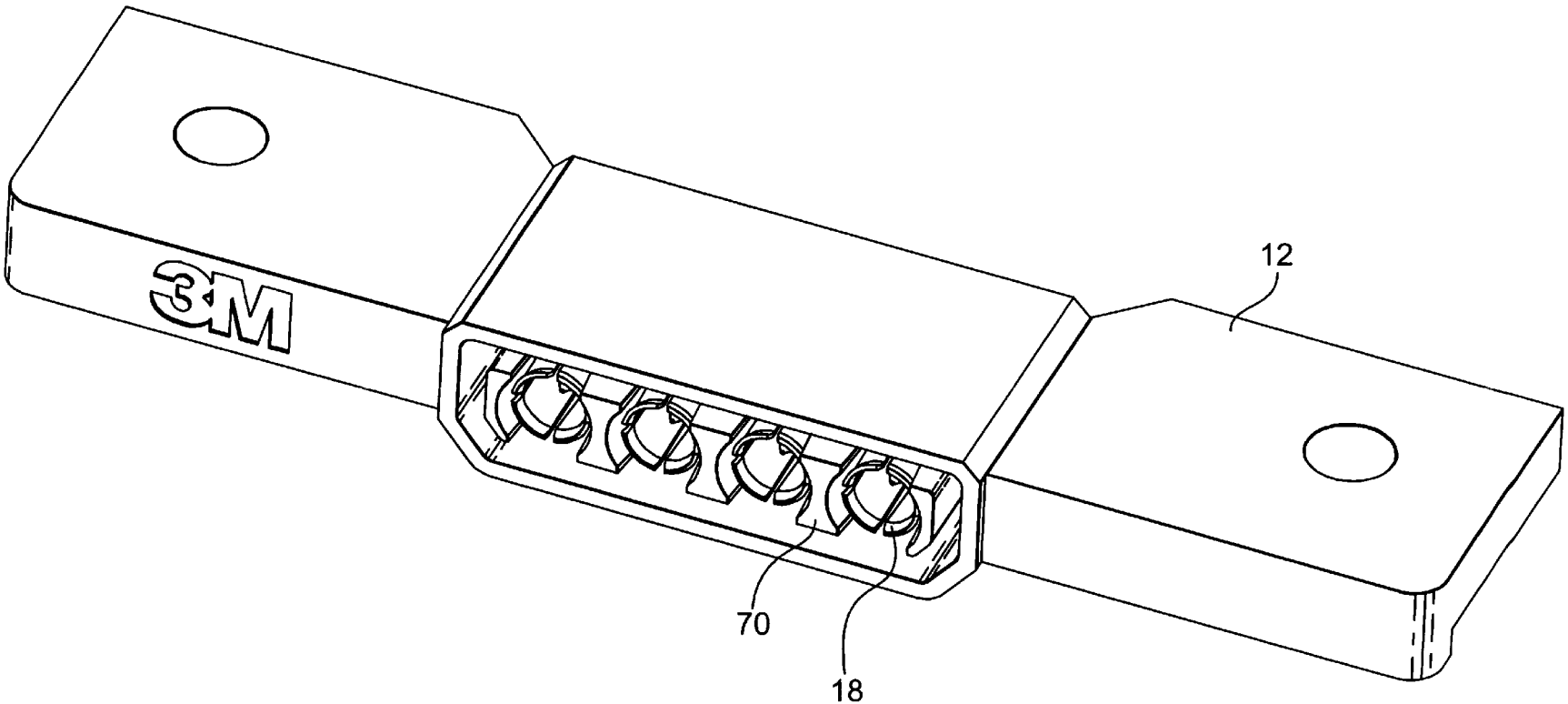
FIG. 10 is an alternate embodiment of the connector assembly.

Other possible variations of the inventive connector described herein will be recognized by those skilled in the art. For example, in some instances stubbing of the shield tubes during mating with another connector may be a concern. In this case, as seen in FIG. 10, anti-stubbing free-standing barriers 70 may be provided between the coaxial connectors. Barriers 70 are integrally formed with insulators 20 and housing 12, and extend from web 22 between insulators 20. Barriers 70 prevent a mating connector shroud (not shown) from damaging shield tubes 18, and additionally provide an overstress stop for spring fingers 43.

Figure 11:
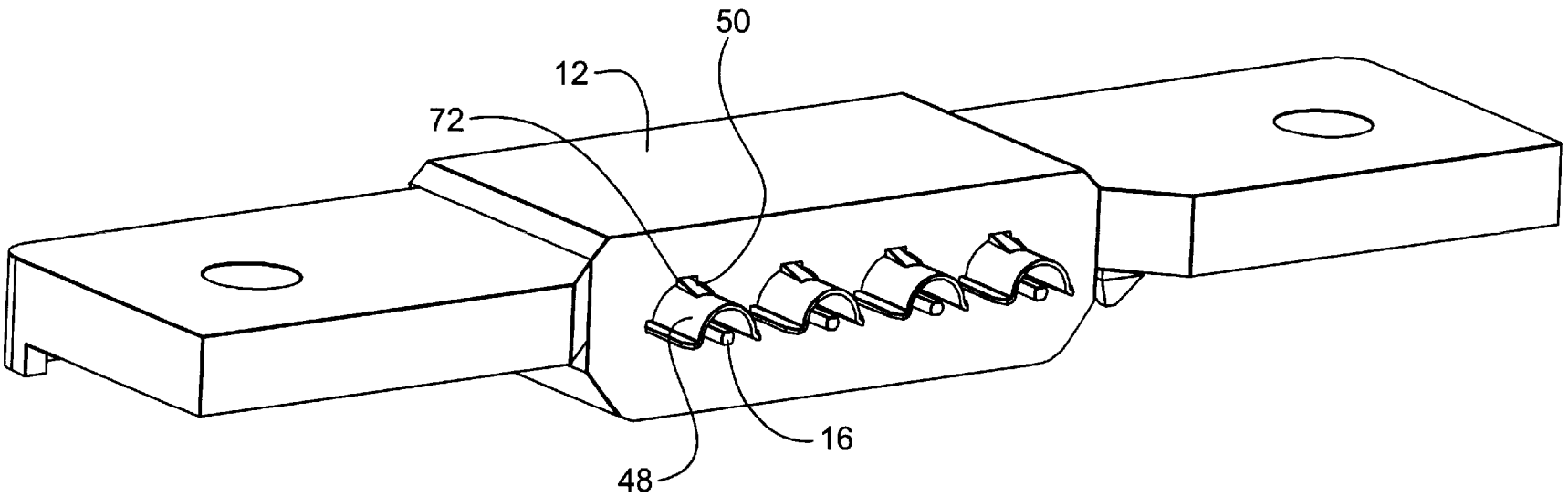
FIG. 11 is yet another alternate embodiment of the connector assembly.

As an additional example, housing 12 may take on any of a variety of shapes and configurations other than those shown. For example, FIG. 11 illustrates that housing 12 need not extend entirely over hood portion 48 of shield tube 18, so that the solder joints may be visually inspected. Also shown in FIG. 11, pockets 72 for receiving locking element 50 are provided in housing 15, to ensure that shield tubes 18 are not inadvertently displaced.

Thus, although illustrative embodiments have been shown and described, a wide range of modifications, change and substitution is contemplated in the foregoing disclosure, and in some instances some features of the embodiments may be employed without a corresponding use of other features. Accordingly, it is appropriate that the appended claims be construed broadly and in a manner consistent with the scope of the embodiments disclosed herein.

What is claimed is:

1. A coaxial connector assembly for attachment to a printed circuit board, the assembly comprising:

a monolithic structure forming an outer housing and a plurality of insulators positioned within the housing;

a plurality of longitudinal signal contacts, one of the plurality of signal contacts coaxially located within a corresponding one of the plurality of insulators, each of the signal contacts including a mating end for connecting to a reciprocal connector and a terminal end for connecting to the printed circuit board; and a plurality of longitudinal shield tubes, one of the plurality of shield tubes surrounding a corresponding one of the plurality of insulators and concentrically positioned about each of the signal contacts therein.

2. The coaxial connector assembly of claim 1, wherein the plurality of insulators are integrally formed with each other.

3. The coaxial connector assembly of claim 1, wherein the mating end of the signal contact has a circular cross section.

4. The coaxial connector assembly of claim 1, wherein the shield tubes are slidably mounted on their corresponding insulators.

5. The coaxial connector assembly of claim 1, further comprising anti-stubbing barriers between adjacent insulators.

6. The coaxial connector assembly of claim 1, wherein the housing and insulator are formed from a dielectric material.

7. The coaxial connector assembly of claim 6, wherein the dielectric constant of the housing and insulator is substantially the same as the dielectric constant of a substrate forming the printed circuit board.

8. The coaxial connector assembly of claim 1, wherein the shield tubes extend over the entire length of the signal contacts.

9. The coaxial connector assembly of claim 8, wherein each of the shield tubes includes a hood adjacent the terminal end of the signal contact to form surface mountable legs.

10. The coaxial connector assembly of claim 1, wherein the terminal end of the signal contact includes a flat surface for mating with the printed circuit board.

11. The coaxial connector assembly of claim 10, wherein the terminal ends of the signal contacts are substantially rectangular in cross-section.

12. The coaxial connector assembly of claim 1, wherein the plurality of integrally formed insulators are connected to the housing by an integrally formed web member.

13. The coaxial connector assembly of claim 12, wherein the web has a thickness of less than ¼ wavelength of the highest frequency for which the connector assembly is designed.

14. A coaxial connector assembly for attachment to a printed circuit board, the assembly comprising:

a monolithic structure forming a plurality of insulators and web members, each of the plurality of insulators spaced from at least one adjacent insulator by one of said web members;

a plurality of longitudinal signal contacts, one of the plurality of signal contacts coaxially located within a corresponding one of the plurality of insulators, each of the signal contacts including a mating end for connecting to a reciprocal connector and a terminal end for connecting to the printed circuit board; and a plurality of longitudinal shield tubes, one of the plurality of shield tubes surrounding a corresponding one of the plurality of insulators and concentrically positioned about each of the signal contacts therein.

15. The coaxial connector assembly of claim 14, further comprising anti-stubbing barriers between adjacent insulators.

16. The coaxial connector assembly of claim 14, wherein the dielectric constant of the insulators is substantially the same as the dielectric constant of a substrate forming the printed circuit board.

17. The coaxial connector assembly of claim 14, further comprising an external housing surrounding the plurality of insulators.

18. The coaxial connector assembly of claim 17, wherein the external housing is integrally formed with the plurality of insulators.

19. The coaxial connector assembly of claim 14, wherein the terminal end of the signal contact includes a flat surface for mating with the printed circuit board.

20. The coaxial connector assembly of claim 19, wherein the flat surfaces of each of the plurality of signal contacts are coplanar.

* * * * *